US006685846B2

(12) United States Patent
Lee et al.

(10) Patent No.: US 6,685,846 B2
(45) **Date of Patent: *Feb. 3, 2004**

(54) BUBBLE-JET TYPE INK-JET PRINTHEAD, MANUFACTURING METHOD THEREOF, AND INK EJECTION METHOD

(75) Inventors: Sang-wook Lee, Seongnam (KR); Hyun-cheol Kim, Seoul (KR); Yong-soo Oh, Seongnam (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/255,758

(22) Filed: Sep. 27, 2002

(65) Prior Publication Data

US 2003/0038862 A1 Feb. 27, 2003

Related U.S. Application Data

(62) Division of application No. 09/842,123, filed on Apr. 26, 2001, now Pat. No. 6,499,832.

(30) Foreign Application Priority Data

Apr. 26, 2000 (KR) ..... 2000-22260

(51) Int. Cl.[7] ..... B41J 2/16

(52) U.S. Cl. ..... 216/27; 216/46; 216/67; 216/79; 216/99; 438/21

(58) Field of Search ..... 216/27, 46, 67, 216/79, 99; 438/21

(56) References Cited

U.S. PATENT DOCUMENTS

| | | | |
|---|---|---|---|
| 3,890,623 | A | 6/1975 | Schmid |
| 4,219,822 | A | 8/1980 | Paranjpe |
| 4,275,290 | A | 6/1981 | Cielo et al. |
| 4,330,787 | A | 5/1982 | Sato et al. |
| 4,339,762 | A | 7/1982 | Shirato et al. |
| 4,353,079 | A | 10/1982 | Kawanabe |

(List continued on next page.)

FOREIGN PATENT DOCUMENTS

| | | |
|---|---|---|
| DE | 30 28 404 | 7/1982 |
| EP | 0 244 214 | 11/1987 |
| EP | 0 317 171 | 5/1989 |
| EP | 0 321 075 | 6/1989 |
| EP | 0 352 498 | 1/1990 |
| EP | 0 352 726 | 1/1990 |
| EP | 0 763 430 | 3/1997 |
| GB | 2 322 831 | 9/1998 |
| JP | 56-144160 | 11/1981 |
| JP | 57-74180 | 5/1982 |
| JP | 61-189949 | 8/1986 |
| JP | 1-190458 | 7/1989 |
| JP | 1-304951 | 12/1989 |

(List continued on next page.)

OTHER PUBLICATIONS

Tseng, et al., "A Novel Microinjector with Virtual Chamber Neck", IEEE Workshop on Micro Electro Mechanical Systems, New York NY/US, IEEE, pp. 57–62, (Jan. 25, 1998).

*Primary Examiner*—Anita Alanko
(74) *Attorney, Agent, or Firm*—Lee & Sterba, P.C.

(57) ABSTRACT

A bubble-jet type ink-jet printhead, a manufacturing method thereof and a method of ejecting ink, wherein, in the printhead, a manifold supplying ink, a hemispherical ink chamber, and an ink channel for connecting the manifold with the ink chamber are integrally formed on the substrate. A nozzle plate on the substrate having a nozzle, and a heater formed in an annular shape and centered around the nozzle are integrated without a complex process such as bonding. Thus, this simplifies the manufacturing process and facilitates high volume production. Furthermore, according to the ink ejection method, a doughnut-shaped bubble is formed to eject ink, thereby preventing a back flow of ink as well as formation of satellite droplets that may degrade image resolution.

8 Claims, 14 Drawing Sheets

U.S. PATENT DOCUMENTS

| | | | | | |
|---|---|---|---|---|---|
| 4,376,945 | A | | 3/1983 | Hara et al. | |
| 4,429,321 | A | | 1/1984 | Matsumoto | |
| 4,463,359 | A | | 7/1984 | Ayata et al. | |
| 4,490,728 | A | | 12/1984 | Vaught et al. | |
| 4,521,805 | A | | 6/1985 | Ayata et al. | |
| 4,536,097 | A | | 8/1985 | Nilsson | |
| 4,580,149 | A | | 4/1986 | Domoto et al. | |
| 4,611,219 | A | | 9/1986 | Sugitani et al. | |
| 4,675,693 | A | | 6/1987 | Yano et al. | |
| 4,675,694 | A | | 6/1987 | Bupara | |
| 4,675,696 | A | | 6/1987 | Suzuki | |
| 4,723,129 | A | | 2/1988 | Endo et al. | |
| 4,812,859 | A | | 3/1989 | Chan et al. | |
| 4,831,390 | A | | 5/1989 | Deshpande et al. | |
| 4,847,630 | A | | 7/1989 | Bhaskar et al. | |
| 4,864,328 | A | | 9/1989 | Fischbeck | |
| 4,864,329 | A | | 9/1989 | Kneezel et al. | |
| 4,882,595 | A | | 11/1989 | Trueba et al. | |
| 4,889,587 | A | | 12/1989 | Komuro | |
| 4,894,664 | A | | 1/1990 | Pan | |
| 4,914,562 | A | * | 4/1990 | Abe et al. | 347/63 |
| 4,985,710 | A | | 1/1991 | Drake et al. | |
| 5,038,153 | A | | 8/1991 | Liechti et al. | |
| 5,305,018 | A | | 4/1994 | Schantz et al. | |
| 5,760,804 | A | | 6/1998 | Heinzl et al. | |
| 5,841,452 | A | * | 11/1998 | Silverbrook | 347/47 |
| 5,850,241 | A | * | 12/1998 | Silverbrook | 347/54 |
| 6,019,457 | A | | 2/2000 | Silverbrook | |
| 6,093,330 | A | * | 7/2000 | Chong et al. | 216/2 |
| 6,478,408 | B2 | * | 11/2002 | Lee et al. | 347/56 |
| 6,533,399 | B2 | * | 3/2003 | Lee et al. | 347/61 |

FOREIGN PATENT DOCUMENTS

| | | | | |
|---|---|---|---|---|
| JP | 3-277550 | | 12/1991 | |
| JP | 4-241955 | | 8/1992 | |
| JP | 04241955 A | * | 8/1992 | B41J/2/16 |
| JP | 5-338178 | | 12/1993 | |
| JP | 7-156402 | | 6/1995 | |
| JP | 9-169117 | | 6/1997 | |
| JP | 10-151765 | | 6/1998 | |
| JP | 10151765 A | * | 6/1998 | B41J/2/175 |
| JP | 10-250075 | | 9/1998 | |

* cited by examiner

BUBBLE-JET TYPE INK-JET PRINTHEAD, MANUFACTURING METHOD THEREOF, AND INK EJECTION METHOD

This application is a DIVISION of application Ser. No. 09/842,123, filed Apr. 26, 2001 now U.S. Pat. No. 6,499,832.

BACKGROUND OF THE INVENTION

1. Field of the Invention

The present invention relates to an ink-jet printhead. More particularly, the present invention relates to a bubble-jet ink-jet printhead, a manufacturing method thereof, and a method of ejecting ink.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electro-mechanical transducer type in which a piezoelectric crystal bends to change the volume of ink causing ink droplets to be expelled.

With reference to FIGS. 1A and 1B, a conventional bubble-jet type ink ejection mechanism will now be described. When a current pulse is applied to a first heater 12 consisting of resistive heating elements formed in an ink channel 10 where a nozzle 11 is located, heat generated by the first heater 12 boils ink 14 to form a bubble 15 within the ink channel 10, which causes an ink droplet 14' to be ejected.

To be useful, an ink-jet printhead having this bubble-jet type ink ejector must meet the following conditions. First, it must have a simplified manufacturing process, i.e., a low manufacturing cost and a high volume of production must be possible. Second, to produce high quality color images, creation of minute satellite droplets that trail ejected main droplets must be prevented. Third, when ink is ejected from one nozzle, or ink refills an ink chamber after ink ejection, cross-talk between an adjacent nozzles from which no ink is ejected must be prevented. To this end, a back flow of ink in the opposite direction of a nozzle must be avoided during ink ejection. Another heater 13 shown in FIGS. 1A and 1B is provided for this purpose. This second heater 13 is similarly capable of forming a bubble 16. Fourth, for a high speed print, a cycle beginning with ink ejection and ending with ink refill must be as short as possible.

However, the above conditions tend to conflict with one another, and furthermore, the performance of an ink-jet printhead is closely associated with structures of an ink chamber, an ink channel, and a heater, the type of formation and expansion of bubbles, and the relative size of each component.

In efforts to overcome problems related to the above requirements, ink-jet printheads having a variety of structures have been proposed in, for example, U.S. Pat. Nos. 4,339,762; 4,882,595; 5,760,804; 4,847,630; and 5,850,241; European Patent No. 317,171, and an article by Fan-Gang Tseng, Chang-Jin Kim, and Chih-Ming Ho entitled, "A Novel Microinjector with Virtual Chamber Neck", IEEE MEMS '98, pp. 57–62. However, the ink-jet printheads proposed in the above patents or literature may satisfy some of the aforementioned requirements but do not completely provide an improved ink-jet printing approach.

SUMMARY OF THE INVENTION

It is a feature of an embodiment of the present invention to provide a bubble-jet type ink-jet printhead having a structure that satisfies the above-mentioned requirements.

It is another feature of an embodiment of the present invention to provide a method of manufacturing the bubble-jet type ink-jet printhead having a structure that satisfies the above-mentioned requirements.

It is a further feature of an embodiment of the present invention to provide a method of ejecting ink in a bubble-jet type ink printhead.

In order to provide the first feature, an embodiment of the present invention provides an ink-jet printhead including a substrate having an ink supply manifold, an ink chamber, and an ink channel, a nozzle plate having a nozzle, and a heater consisting of resistive heating elements, and an electrode for applying current to the heater. The manifold supplying ink, the ink chamber filled with ink to be ejected, and the ink chamber for supplying ink from the manifold to the ink chamber are integrally formed on the substrate. The nozzle plate is stacked on the substrate, wherein the nozzle plate has the nozzle at a location corresponding to the central part of the ink chamber. The heater is formed in an annular shape on the nozzle plate and centered around the nozzle of the nozzle plate. The ink chamber is substantially hemispherical. The ink channel further includes a bubble barrier for reducing the diameter of the ink channel prior to the ink chamber.

In a preferred embodiment, a bubble guide and a droplet guide, both of which extend down the edges of the nozzle in the depth direction of the ink chamber are formed to guide the direction in which a bubble grows and the shape of the bubble, and the ejection direction of an ink droplet during ink ejection, respectively. The heater is formed in the shape of a horseshoe so that the bubble has a substantially doughnut shape.

In order to provide the second feature, an embodiment of the present invention provides a method of manufacturing a bubble-jet type ink-jet printhead, in which a substrate is etched to form an ink chamber, an ink channel, and ink supply manifold thereon. A nozzle plate is formed on the surface of the substrate, and an annular heater is formed on the nozzle plate. The substrate is etched to form the ink supply manifold. Furthermore, electrodes for applying current to the annular heater are formed. A nozzle plate is etched to form a nozzle having a diameter less than the annular heater on the inside of the annular heater. The substrate exposed by the nozzle is etched to form the substantially hemispherical ink chamber having a diameter greater than the annular heater. The substrate is etched from the surface to form the ink channel for connecting the ink chamber with the manifold.

In a preferred embodiment, the ink chamber is formed by anisotropically etching the substrate exposed by the nozzle to a predetermined depth, and isotropically etching the substrate, so that it has a hemispherical shape.

In a preferred embodiment, in order to form the ink channel, the nozzle plate is etched from the outside of the annular heater toward the manifold to form a groove for exposing the substrate at the same time that a nozzle plate is etched to form the nozzle. Then, the substrate exposed by the groove is etched at the same time that the substrate is isotropically etched for forming the ink chamber.

In a preferred embodiment, in order to form the ink chamber, the substrate exposed by the nozzle is etched to a predetermined depth to form a trench. Then, a predetermined material layer is deposited over the anisotropically etched substrate to a predetermined thickness and the material layer is anisotropically etched to expose the bottom of the trench and form a spacer of the material layer along the sidewalls of the trench. Then, the substrate exposed to the bottom of the trench is isotropically etched.

In order to provide the third feature, an embodiment of the present invention provides a method of ejecting ink in a bubble-jet type ink-jet printhead. According to the ejection method, a bubble having a substantially doughnut shape, the center portion of which opposes the nozzle, is formed within the ink chamber filled with ink. The doughnut-shaped bubble expands and coalesces under the nozzle to cut off the tail of an ejected ink droplet.

According to an embodiment of the present invention, a bubble is formed in a doughnut shape, which satisfies the above requirements for ink ejection. Furthermore, this embodiment allows a simple manufacturing process and high volume production of printheads in chips.

These and other features and advantages of the embodiments of the present invention will be readily apparent to those of ordinary skill in the art upon review of the detailed description that follows.

BRIEF DESCRIPTION OF THE DRAWINGS

The above features and advantages of the present invention will become more apparent by describing in detail preferred embodiments thereof with reference to the attached drawings in which.

DETAILED DESCRIPTION OF THE PREFERRED EMBODIMENTS

Figure 1A:
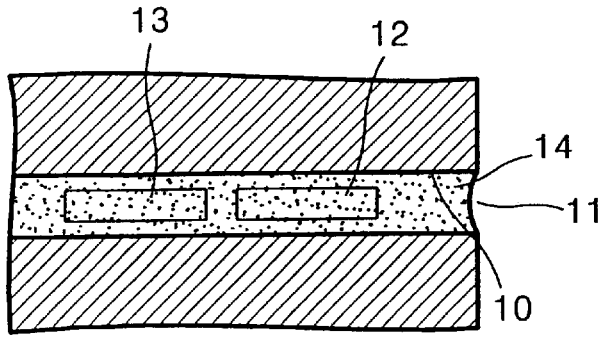
FIG. 1A (PRIOR ART)
FIGS. 1A and 1B illustrate cross-sections showing the structure of a conventional bubble-jet ink jet printhead along with an ink ejection mechanism.
Figure 1B:
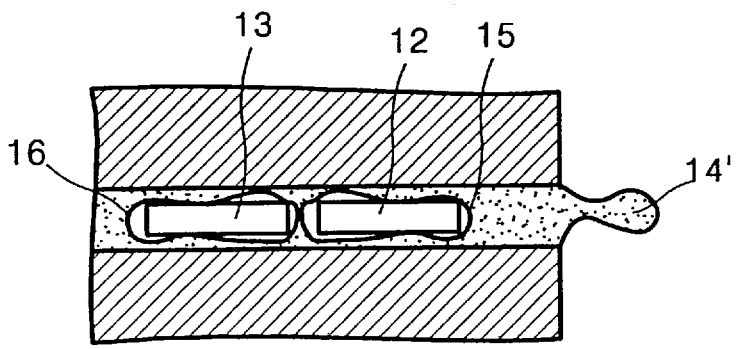
FIG. 1B (PRIOR ART)

Korean Patent Application No. 00-22260, filed on Apr. 26, 2000, and entitled, "Bubble-jet Type Ink-jet Printhead, Manufacturing Method Thereof, and Ink Ejection Method," is incorporated by reference herein in its entirety.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the concept of the invention to those skilled in the art. In the drawings, the shape of elements is exaggerated for clarity, and the same reference numerals appearing in different drawings represent the same element. Further, it will be understood that when a layer is referred to as being "on" another layer or substrate, it can be directly on the other layer or substrate, or intervening layers may also be present.

Figure 2:
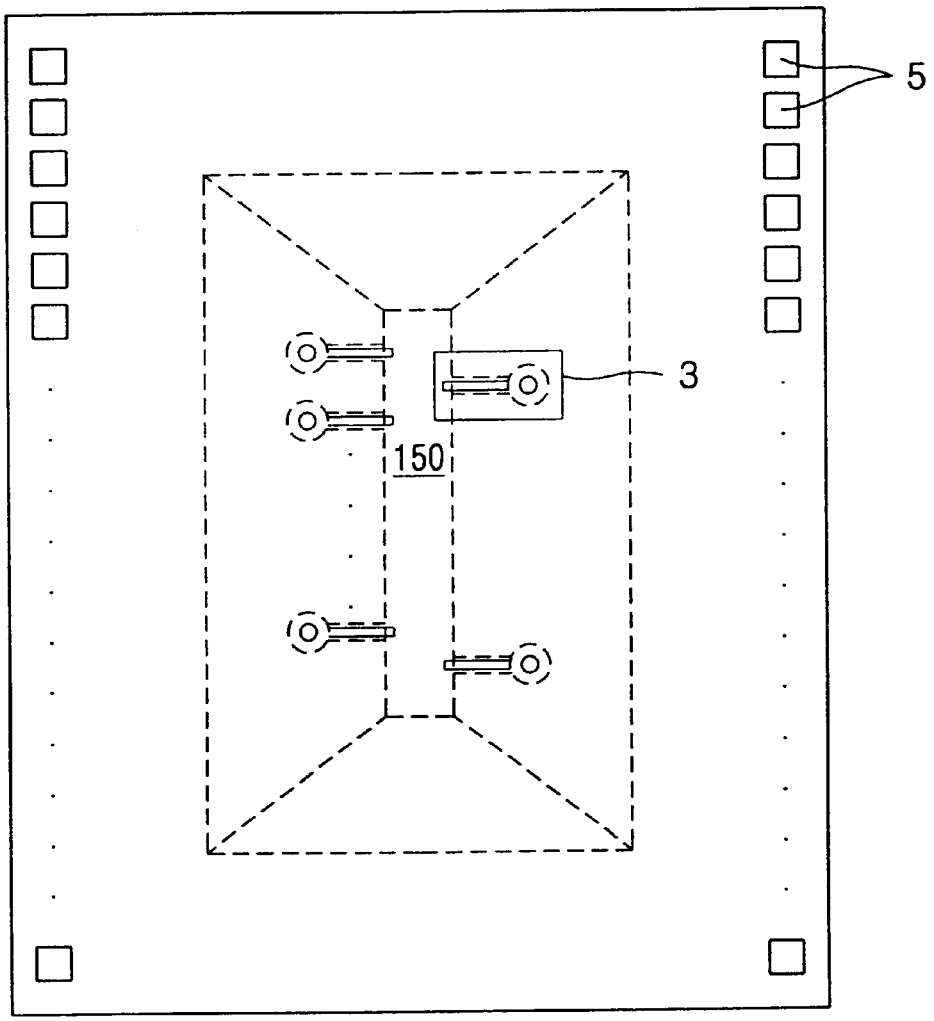
FIG. 2 illustrates a schematic plan view of a bubble-jet type ink-jet printhead according to an embodiment of the present invention.

Referring to FIG. 2, in a printhead according to the present invention, ink ejectors 3 are arranged in two rows in a zig-zag pattern along both sides of an ink supply manifold 150 shown with a dotted line. Bonding pads 5, to which wires are bonded, electrically connect to each ink ejector 3. Furthermore, the manifold 150 connects with an ink container (now shown) for holding ink. Although the ink ejectors 3 are arranged in two rows as shown in FIG. 2, they may also be arranged in a single row. Alternatively, to achieve high resolution, they may be arranged in three rows. Furthermore, a printhead using a single color of ink is illustrated in FIG. 2, but three (yellow, magenta and cyan), or four (yellow, magenta, cyan, and black) groups of ink ejectors may be disposed, one group for each color for color printing.

Figure 3A:
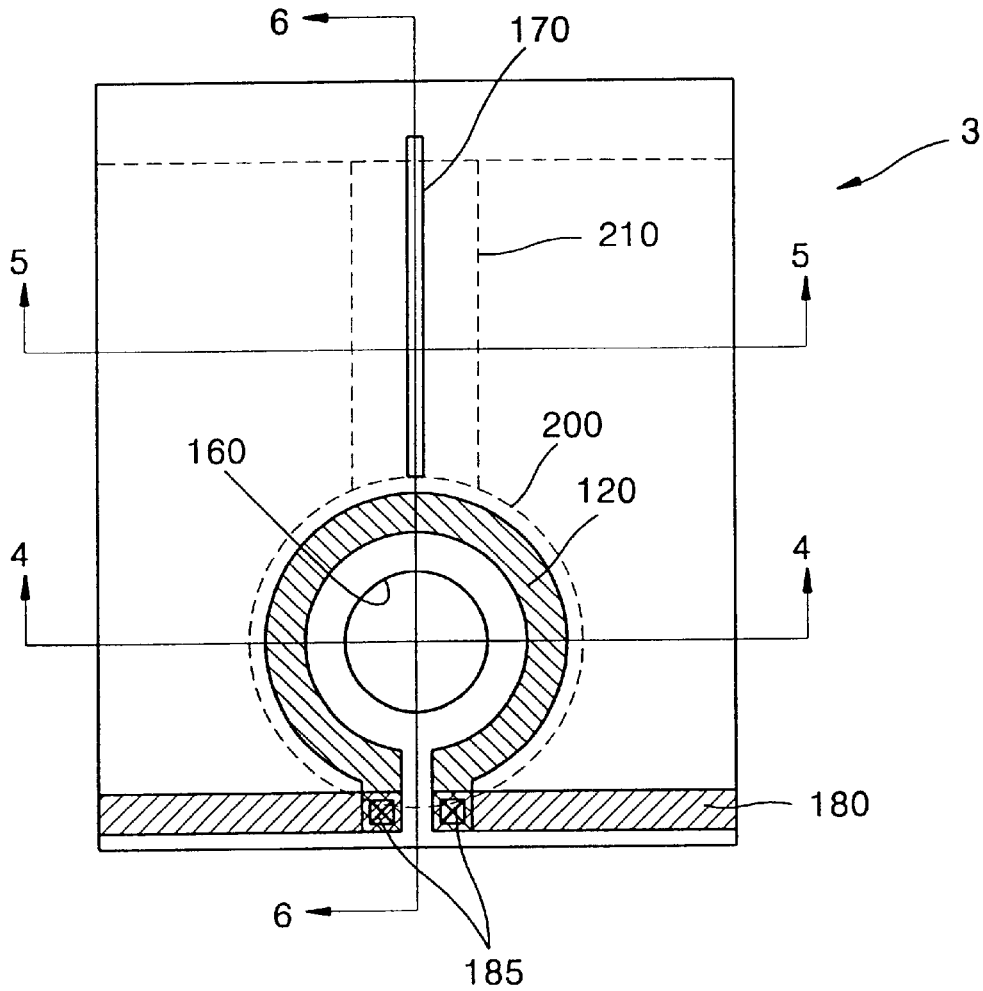
FIGS. 3A and 3B illustrate plan views of the unit ink ejector of FIG. 2.
Figure 4A:
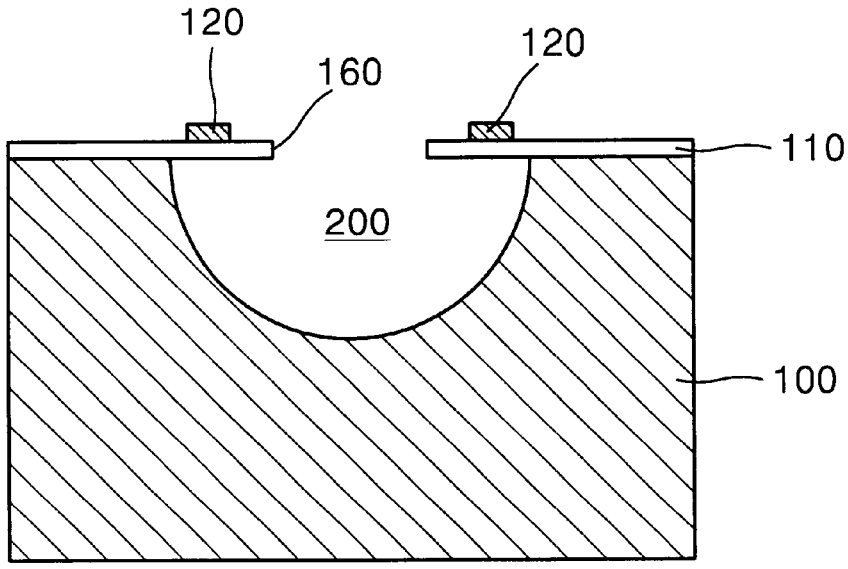
FIGS. 4A and 4B illustrate cross-sections of a printhead according to an embodiment of the present invention, taken along line 4—4 of FIG. 3A.
Figure 5:
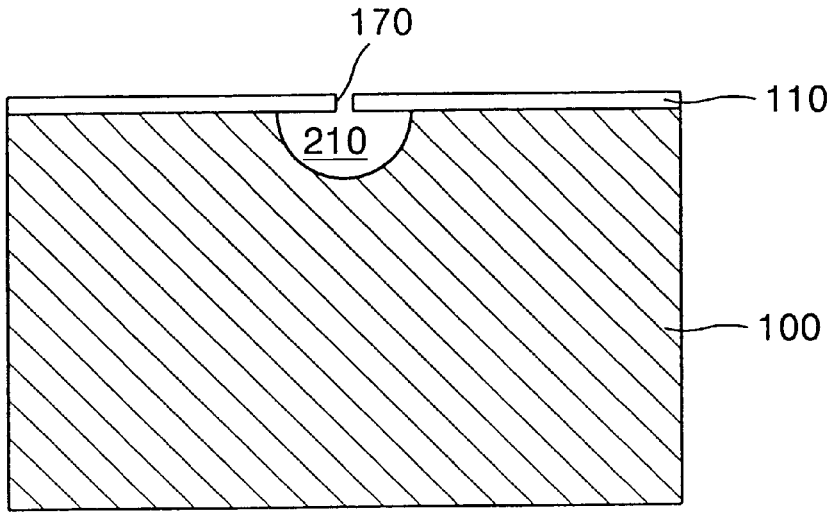
FIGS. 5 and 6 illustrate cross-sections of a printhead according to an embodiment of the present invention, taken along lines 5—5 and 6—6 of FIG. 3A, respectively.
Figure 6:
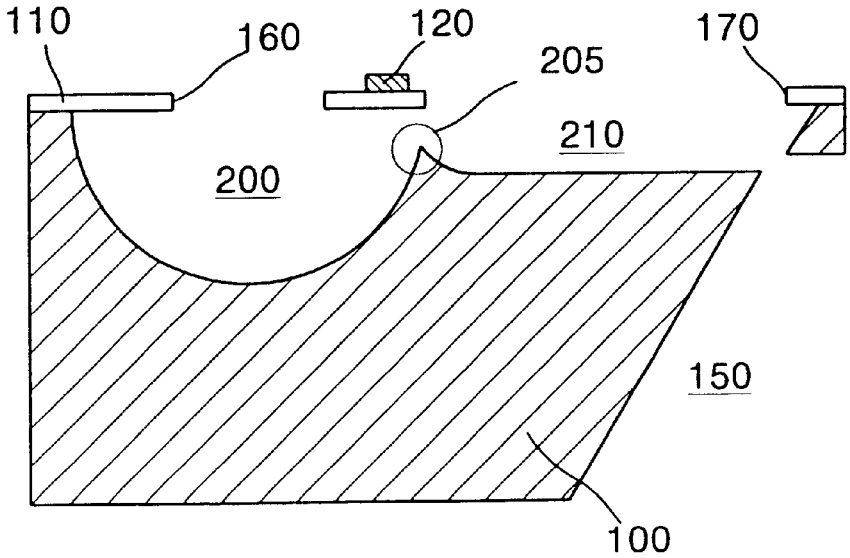

FIG. 3A illustrates a plan view of the ink ejector which is a feature of present invention. FIGS. 4A, 5 and 6 illustrate cross-sections of a printhead according to an embodiment of the present invention, taken along lines 4—4, 5—5, and 6—6, respectively. The structure of the printhead according to a first embodiment of the present invention will now be described in detail with reference to FIGS. 3A–6.

An ink chamber 200 for containing ink, having a substantially hemispherical-shape, is formed on the surface of a substrate 100, and an ink channel 210 for supplying ink to the ink chamber 200 is formed shallower than the ink chamber 200. The manifold 150 for connecting to the ink channel 210 and thus supplying ink to the ink channel 210 is formed on the rear surface of the substrate 100. Furthermore, a bubble barrier 205 (FIG. 6), which prevents a bubble from being pushed back into the ink channel 210 when the bubble expands, projects out slightly toward the surface of the substrate 100 at a point where the ink chamber 200 and the ink channel 210 meet each other. Here, the substrate 100 is preferably made out of silicon having the same crystal orientation [100] as is widely used in manufacturing an integrated circuit.

A nozzle 160 and a nozzle plate 110, in which a groove 170 for an ink channel is formed, are formed on the substrate 100, thus forming an upper wall of the ink chamber 200 and the ink channel 210. If the substrate 100 is formed of silicon, the nozzle plate 110 may be formed of a silicon oxide layer formed by the oxidation of the silicon substrate 100 or a silicon nitride layer deposited on the silicon substrate 100.

A heater 120 having an annular shape for forming a bubble is disposed on the nozzle plate 110 so as to surround the nozzle 160. As shown in FIG. 3A, the heater 120 consisting of resistive heating elements such as polycrystalline silicon has an approximate shape of a horseshoe combined with electrodes 180 that are typically made of metal for applying a current pulse to the heater 120. The heater 120 and the electrodes 180 are electrically connected by contacts 185. Also, the electrodes 180 are connected to the bonding pad (5 of FIG. 2).

Figure 3B:
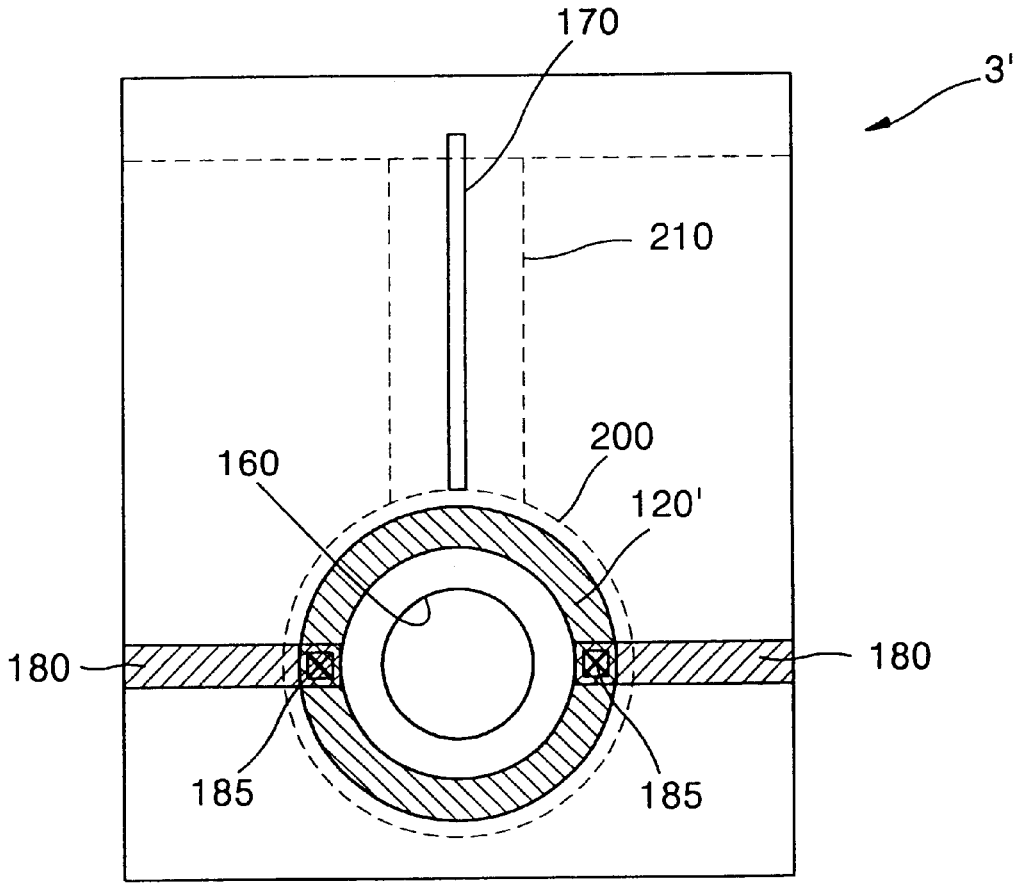
Figure 4B:
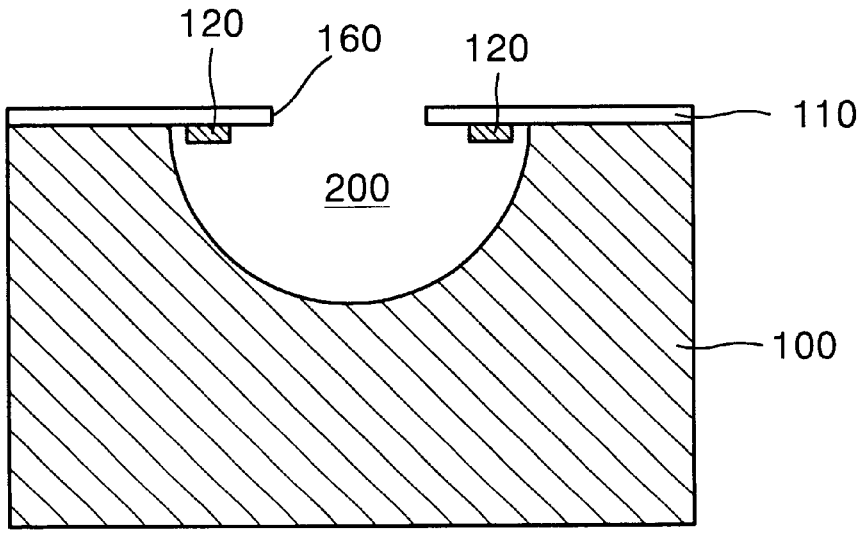

Meanwhile, FIGS. 3B and 4B illustrate a plan view and a cross-section talk along line 4—4 of FIG. 3A, respectively, which show a modified example of this embodiment, an alternate ink ejector 3'. Referring to FIG. 3B, a heater 120' has a round shape and is connected to the electrodes 180 by the contacts 185 at approximately symmetrical locations.

Referring to FIG. 4B, the heater 120 is disposed beneath a nozzle plate 110' so as to contact ink that fills the ink chamber 200.

Figure 7:
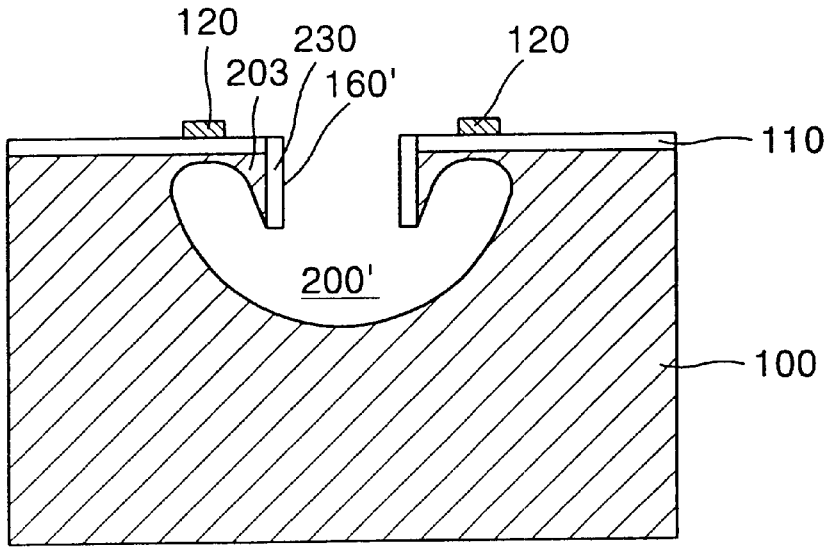
FIGS. 7 and 8 illustrate cross-sections of a printhead according to another embodiment of the present invention, taken along lines 4—4 and 6—6 of FIG. 3A, respectively.
Figure 8:
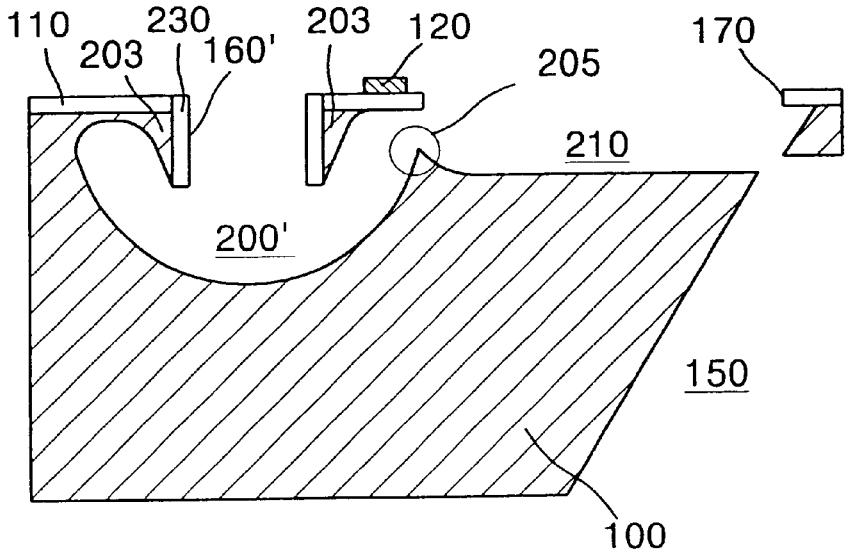

FIGS. 7 and 8 illustrate cross-sections taken along lines 4—4 and 6—6 of FIG. 3A, respectively, which show the structure of a printhead according to a second embodiment of the present invention. Referring to FIGS. 3A, 7 and 8, although the printhead according to this embodiment basically has a similar structure to the first embodiment, it differs from the first embodiment in the structures of an ink chamber 200' and a nozzle 160'. Specifically, the bottom of the ink chamber 200' is substantially hemispherical like the ink chamber 200 of the first embodiment, but a droplet guide 230 and a bubble guide 203 are disposed at an upper portion of the ink chamber 200'. The droplet guide 230 extends down the edge of the nozzle 160' toward the ink chamber 200', and the bubble guide 203 is formed under the nozzle plate 110, which forms the upper wall of the ink chamber 200', with a substrate material remaining along the inner surface of the droplet guide 230. The functions of the droplet guide 230 and the bubble guide 203 will be described below.

The functions and effects of the ink-jet printheads according to the first and second embodiments of the present invention will now be described together with a method of ejecting ink according to the present invention.

Figure 9:
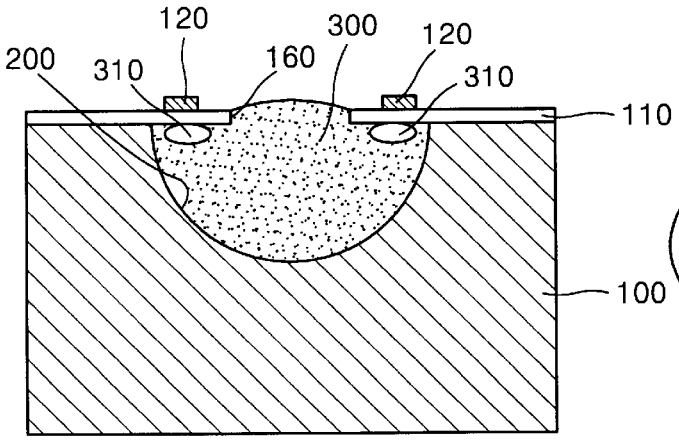
FIGS. 9 and 10 illustrate cross-sections showing a method of ejecting ink in a bubble-jet type printhead according to an embodiment of the present invention.
Figure 9A:
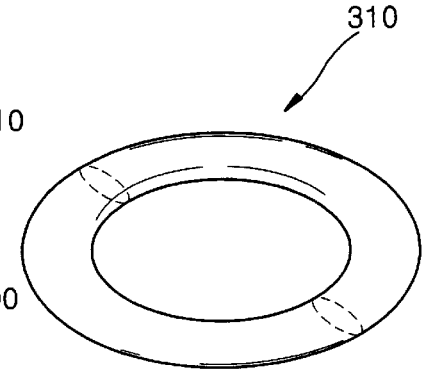
Figure 10:
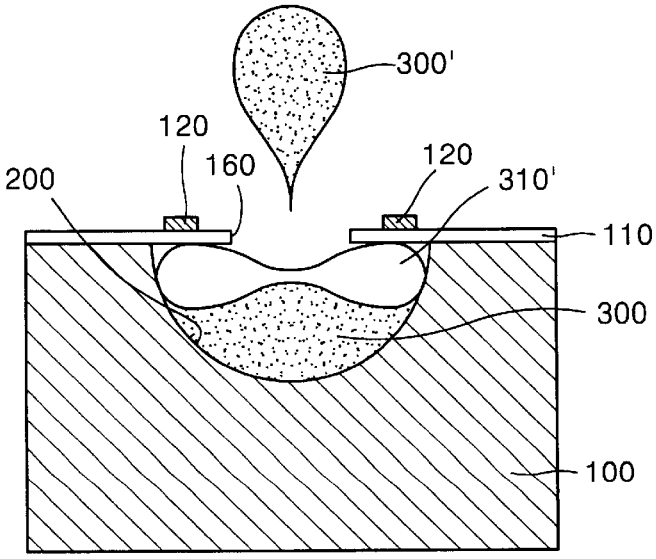
Figure 10A:
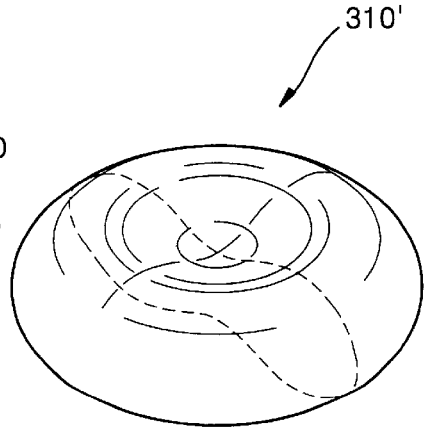

FIGS. 9 and 10 show the ink ejection mechanism for the printhead according to the first embodiment of the present invention. As shown in FIG. 9, if a current pulse is applied to the annular heater 120 when the ink chamber 200 is filled with ink 300 supplied through the manifold 150 and the ink channel 210 by capillary action, then heat generated by the heater 120 is transmitted through the underlying nozzle plate 110, which boils the ink 300 under the heater 120 to form bubbles 310. The bubbles 310 have an approximately doughnut shape conforming to the annular heater 120 as shown in FIG. 9A.

If the doughnut-shaped bubbles 310 expand with the lapse of time, as shown in FIG. 10, the bubbles 310 coalesce below the nozzle 160 to form a substantially disk-shaped bubble 310', as shown in FIG. 1A, the center portion of which is concave. At the same time, the expanding bubble 310' causes an ink droplet 300' from within the ink chamber 200 to be ejected. If the applied current cuts off, the heater 120 is cooled to shrink or collapse the bubble 310', and then the ink 300 refills the ink chamber 200.

In the ink ejection mechanism according to this embodiment, the doughnut-shaped bubbles 310 coalesce to cut off the tail of the ejected ink droplet 300', thus preventing the formation of any satellite droplets. Furthermore, the expansion of the bubble 310 or 310' is limited within the ink chamber 200, which prevents a back flow of the ink 300, so that cross-talk between adjacent ink ejectors does not occur. Furthermore, since the ink channel 210 is shallower and smaller than the ink chamber and the bubble barrier 205 is formed at the point where the ink chamber 200 and the ink channel 210 meet each other, as shown in FIG. 6, it is very effective in preventing the bubble itself 310 or 310' from being pushed toward the ink channel 210.

Meanwhile, the area of the annular heater 120 is wide enough so as to be rapidly heated and cooled, which quickens a cycle beginning with the formation of the bubble 310 or 310' ending with the collapse, thereby allowing for a quick response rate and high driving frequency. Furthermore, since the ink chamber 200 is hemispherical, a path along which the bubbles 310 and 310' expand is more stable compared to a conventional ink chamber having the shape of a rectangular solid or a pyramid, and the formation and expansion of a bubble are quickly made thus ejecting ink within a relatively short time.

Figure 11:
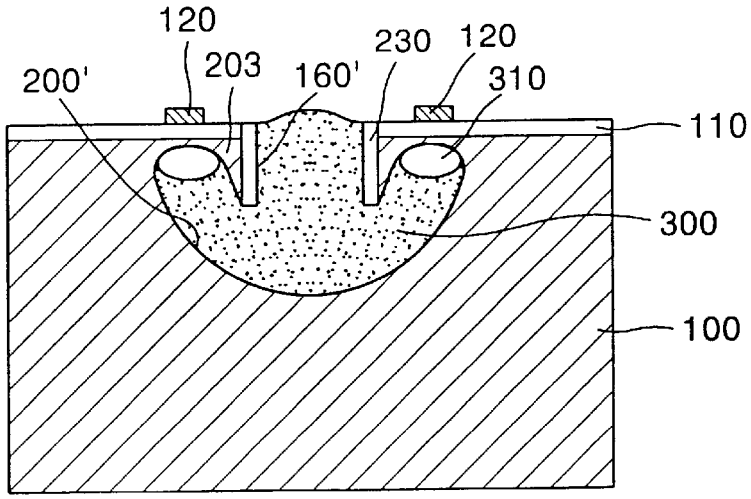
FIGS. 11 and 12 illustrate cross-sections showing a method of ejecting in a bubble-jet type printhead according to an embodiment of the present invention.
Figure 12:
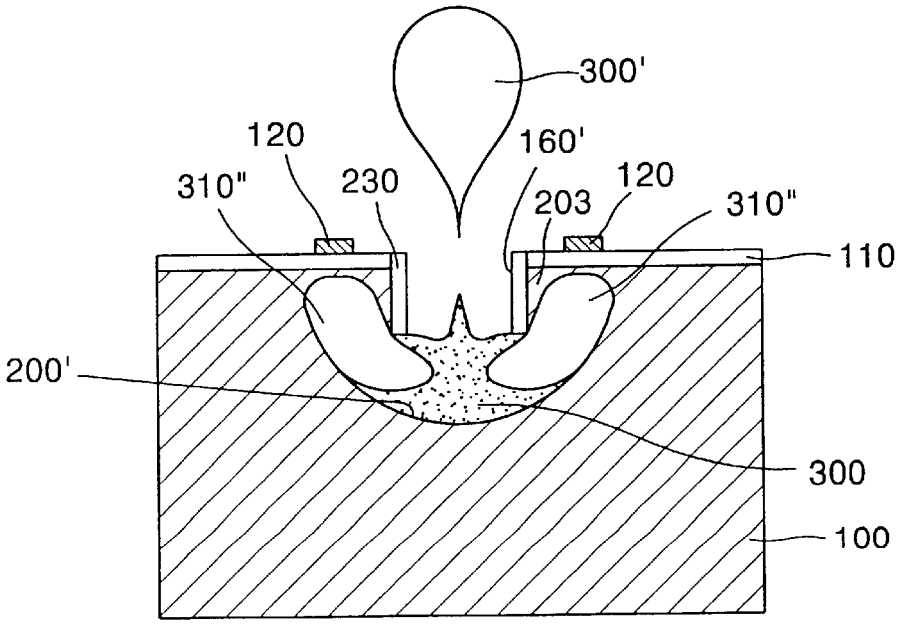

FIGS. 11 and 12 illustrate an ink ejection mechanism for the printhead according to the second embodiment of the invention. The difference from the ink ejection method for the printhead according to the first embodiment will now be described.

First, since bubbles 310" expand downward by the bubble guide 203 near the nozzle 160', there is little possibility that the bubbles 310" will coalesce below the nozzle 160'. However, the possibility that the expanding bubbles 300" will merge under the nozzle 160' may be controlled by controlling the length by which the droplet guide 230 and the bubble guide 203 extend downward. The ejection direction of the ejected droplet 300' is guided by the droplet guide 230 extending down the edges of the nozzle 160' so that the direction is exactly perpendicular to the substrate 100.

Next, a method of manufacturing an ink-jet printhead according to the present invention will now be described. FIGS. 13–19 illustrate cross-sections showing a method of manufacturing the printhead according to the present invention. The left and right sides of the drawings are cross-sections taken along lines 4—4 and 6—6 of FIG. 3A, respectively. The same is true of FIGS. 20–22.

Figure 13:
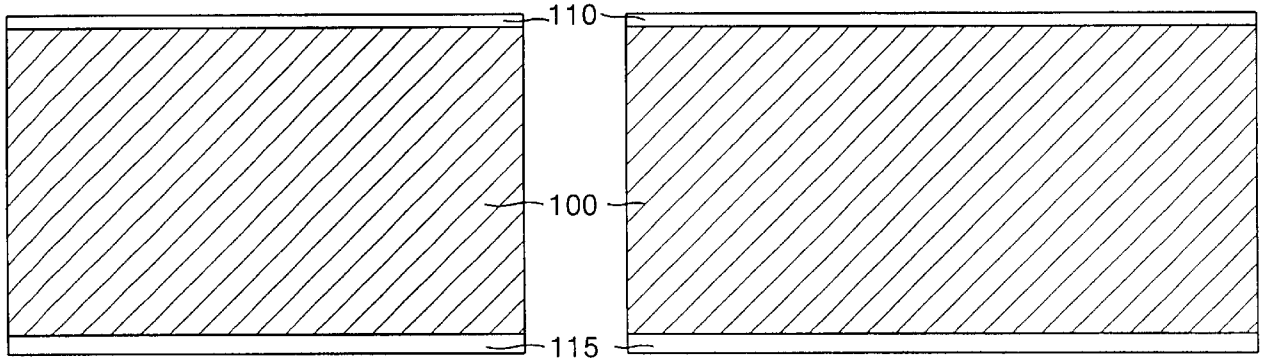
FIGS. 13–19 illustrate cross-sections showing a process of manufacturing a bubble-jet type ink-jet printhhead according to an embodiment of the present invention.

First, the substrate 100 is prepared. A silicon substrate having a crystal orientation of [100] and having a thickness of about 500 $\mu$m is used as the substrate 100 in this embodiment. This is because the use of a silicon wafer widely used in the manufacture of semiconductor devices allows for high volume production. Next, if the silicon wafer is wet or dry oxidized in an oxidation furnace, as shown in FIG. 13, the front and rear surfaces of the silicon substrate 100 are oxidized, thereby allowing silicon oxide layers 110 and 115 to grow. A very small portion of the silicon wafer is shown in FIG. 13, and a printhead according to this invention is fabricated by tens to hundreds of chips on a single wafer. That is, FIG. 13 shows only the unit ink ejector 3 in the chip as shown in FIG. 2. Furthermore, as shown in FIG. 13, the silicon oxide layers 110 and 115 are grown on both front and rear surfaces of the substrate 100. This is because a batch type oxidation furnace exposed to an oxidation atmosphere is used on the rear surface of the silicon wafer as well. However, if a single wafer type oxidation apparatus exposing only a front surface of a wafer is used, the silicon oxide layer 115 is not formed on the rear surface of the substrate 100. The fact that a predetermined material layer is formed on a front or rear surface of the substrate 100 depending on the type of an oxidation apparatus is true of FIGS. 20–22. For convenience, it will now be shown that a different material layer, such a polycrystalline silicon layer, a silicon nitride layer and a tetraethyleorthosilicate (TEOS) oxide layer as will be described below, is formed only on the front surface of the substrate 100.

Figure 14:
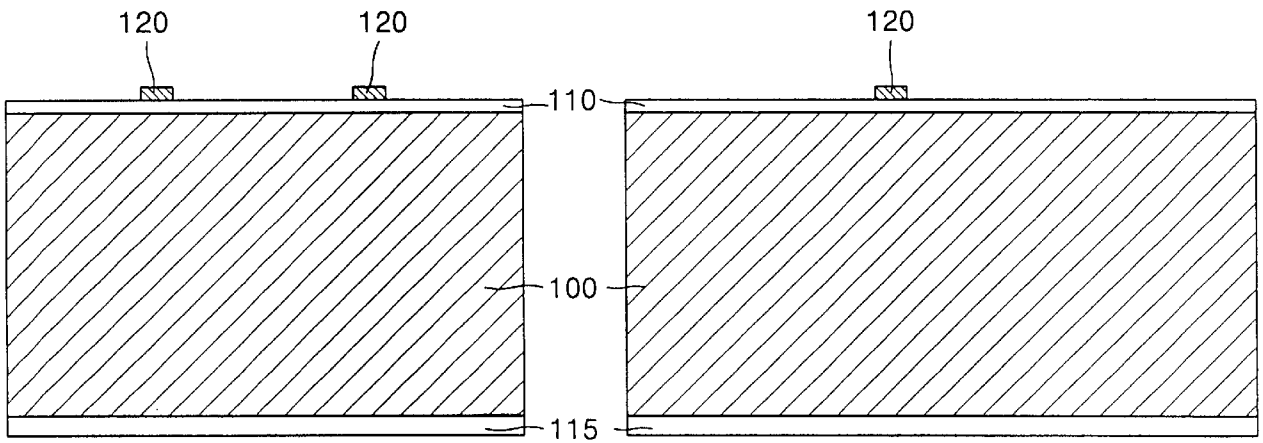

FIG. 14 illustrate a state in which the annular heater 120 has been formed. The annular heater 120 is formed by depositing polycrystalline silicon over the silicon oxide layer 110 and patterning the polycrystalline silicon layer in the form of an annulus. Specifically, the polycrystalline silicon may be deposited to a thickness of about 0.8 $\mu$m by means of low pressure chemical vapor deposition (CVD). The polycrystalline silicon layer is patterned by photolithography using a photo mask and photoresist and an etching process of etching the polycrystalline silicon layer deposited over the silicon oxide layer 100 using a photoresist pattern as an etch mask.

Figure 15:
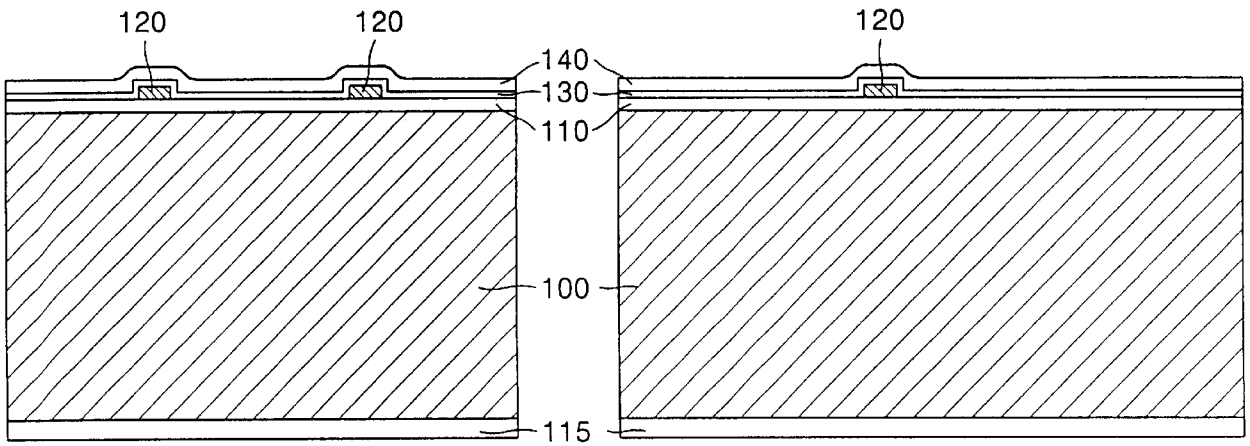

FIG. 15 illustrates a state in which a silicon nitride layer 130 and a TEOS oxide layer 140 have been sequentially formed over the resulting material shown in FIG. 14. A silicon nitride layer 130 may also be deposited to a thickness of about 0.5 $\mu$m by low pressure CVD as a protective layer over the annular heater 120, while a TEOS oxide layer 140 may be deposited to a thickness of about 1 $\mu$m by CVD.

Figure 16:
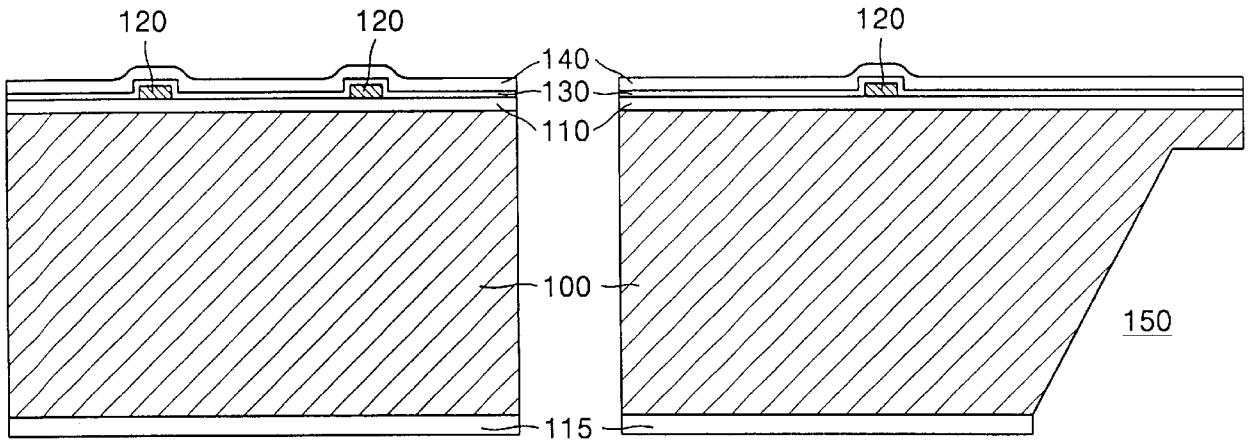

FIG. 16 shows a state in which the ink supply manifold 150 has been formed. The manifold 150 is formed by obliquely etching the rear surface of the wafer. More specifically, an etch mask that limits a region to be etched is formed on the rear surface of the wafer, and wet etching is performed for a predetermined period of time using tetramethyl ammonium hydroxide (TMAH) as an etchant. Then, etching in a crystal orientation of [111], which is slower than etching in other orientations, to form the manifold 150 with a side surface inclined at 54.7°.

Although it has been described though FIG. 16 that the manifold 150 is formed by obliquely etching the rear surface of the substrate 100, the manifold 150 may be formed by anisotropic etching, penetrating and the substrate 100, or etching the front surface of the substrate 100.

Figure 17:
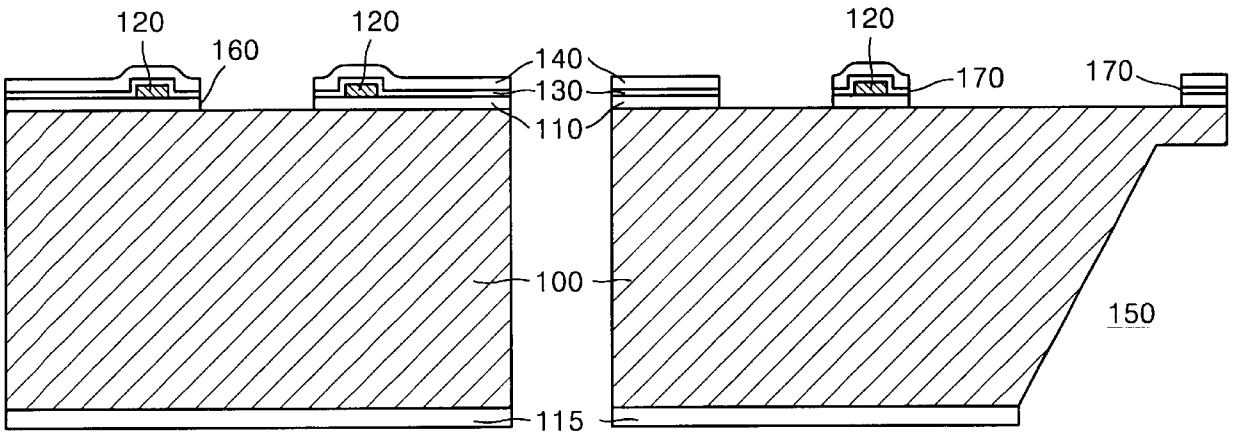

Referring to FIG. 17, the TEOS oxide layer 140, the silicon nitride layer 130, and the silicon oxide layer 110 are sequentially etched to form an opening 160 exposing the substrate 100 with a diameter less than an inner diameter of the annular heater 120. At the same time, a second opening 170 (FIG. 19) is formed on the outside of the annular heater 120 in a straight line up to the upper portion of the manifold 150. The second opening 170 is a groove which will be used in etching the substrate 100 for forming an ink channel. The second opening 170 has a length of about 50 $\mu$m and a width of about 2 $\mu$m.

Meanwhile, to form the electrodes (180 of FIG. 3) for applying current to the annular heater 120 and the contacts 185 for electrically connecting the annular heater 120 with the electrodes 180, first, the TEOS oxide layer 140 and the silicon nitride layer 130 deposited on a portion where the contacts 185 will be formed are removed to expose a portion of the annular heater 120. Then, a conductive metal such as aluminum is deposited over the resulting structure to a thickness of about 1 $\mu$m. Copper may be used as the electrodes 180 by electroplating.

Figure 18:
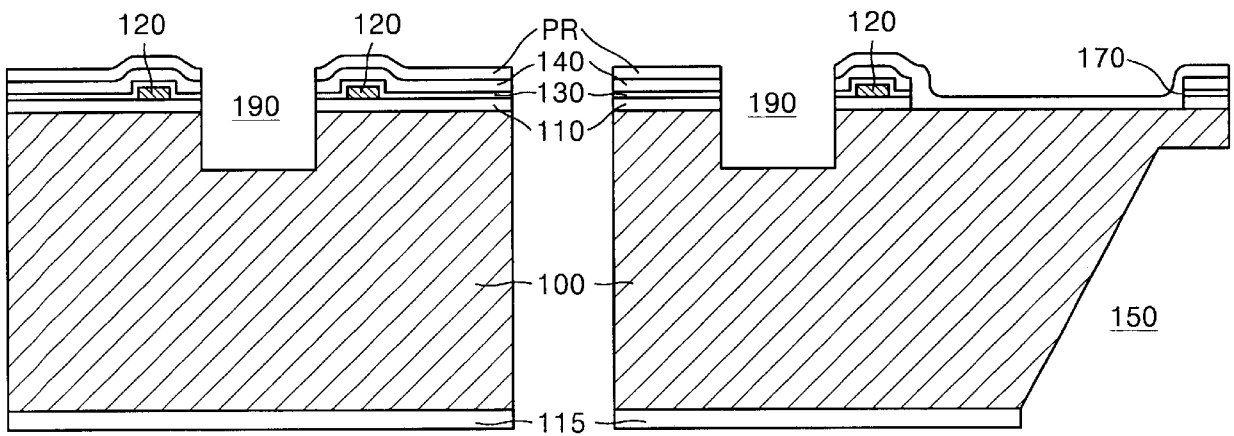

FIG. 18 illustrates a state in which the substrate exposed by the opening 160 is etched to a predetermined depth to form a trench 190. In this case, the substrate 100 exposed by the second opening 170 is not etched. More specifically, after an etch mask such as a photoresist layer PR that exposes only the opening 160 is formed on the substrate 100, the silicon substrate 100 is etched by means of dry etching using inductively coupled plasma or reactive ion etching.

Figure 19:
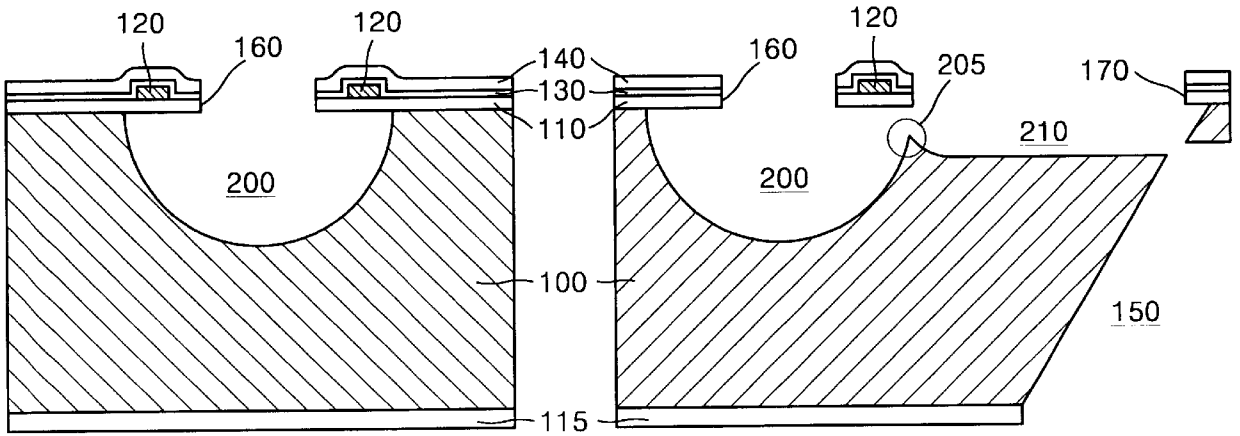

FIG. 19 shows a structure obtained by removing the photoresist layer PR by means of ashing and strip in the state shown in FIG. 18 and isotropically etching the exposed silicon substrate 100. More specifically, the substrate 100 is etched for a predetermined period of time using $XeF_2$ as an etch gas. Then, as shown in FIG. 19, the substantially hemispherical ink chamber 200 is formed with depth and radius of about 20 $\mu$m, and the ink channel 210 for connecting the ink chamber 200 with the manifold 150 is formed with depth and radius of about 8 $\mu$m. Also, the projecting bubble barrier 205 is formed by etching at the point where the ink chamber 200 and the ink channel 210 connect. In this way, the printhead according to the first embodiment of the present invention is completed.

Meanwhile, only the substrate 100 exposed by the opening 160 is etched as shown in FIG. 18 so as to limit a doughnut-shaped bubble within the ink chamber 200 by making the depth of the ink chamber 200 deeper than that of the ink channel 210 as shown in FIG. 19. However, since an etch rate varies due to the difference in the width of the openings 160 and 170 during isotropic etching shown in FIG. 19, the ink chamber 200 and the ink channel 210 are formed to have different depths. Thus, the step shown in FIG. 18 may be omitted.

Furthermore, the printhead having a structure in which the heater 120' is disposed beneath the nozzle plate 110 as shown in FIG. 4B may be manufactured by etching and removing the silicon oxide layer 110 exposed to the ink chamber 200 in a state shown in FIG. 19. The thus-exposed heater 120 directly contacts ink. To prevent attachment of ink, a silicon oxide layer or a silicon nitride layer may be deposited thinly over the exposed heater 120 as a protective layer.

Figure 20:
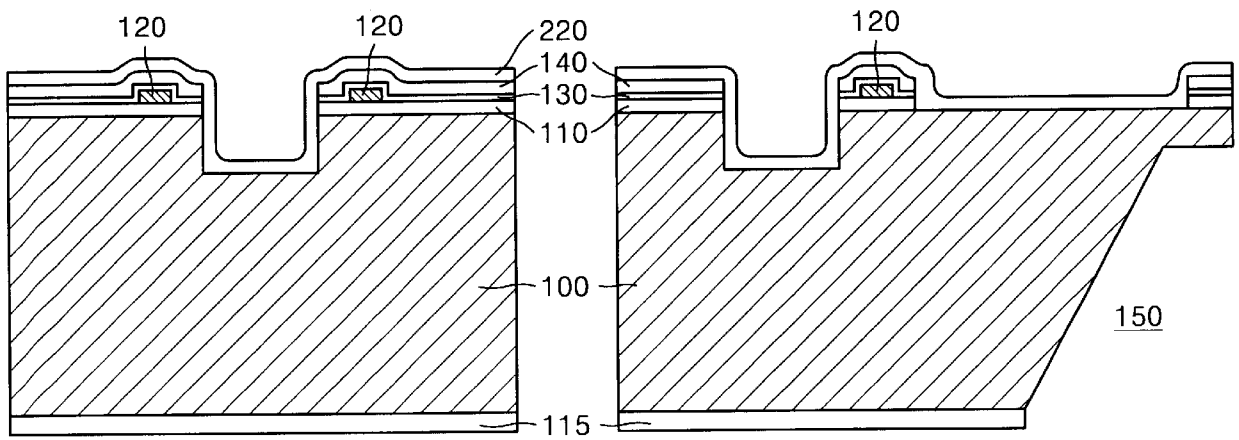
FIGS. 20–22 illustrate cross-sections showing a process of manufacturing a bubble-jet type printhead according to another embodiment of the present invention.
Figure 21:
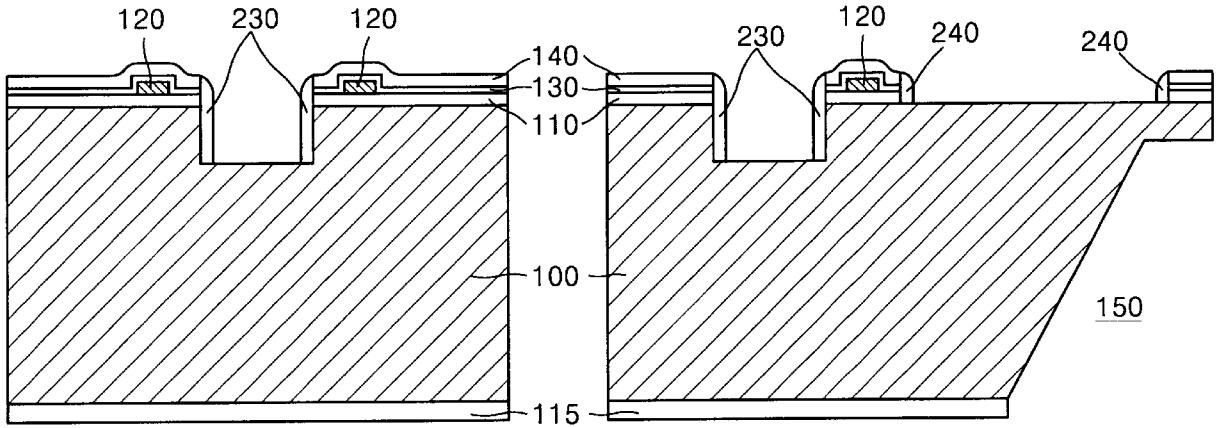
Figure 22:
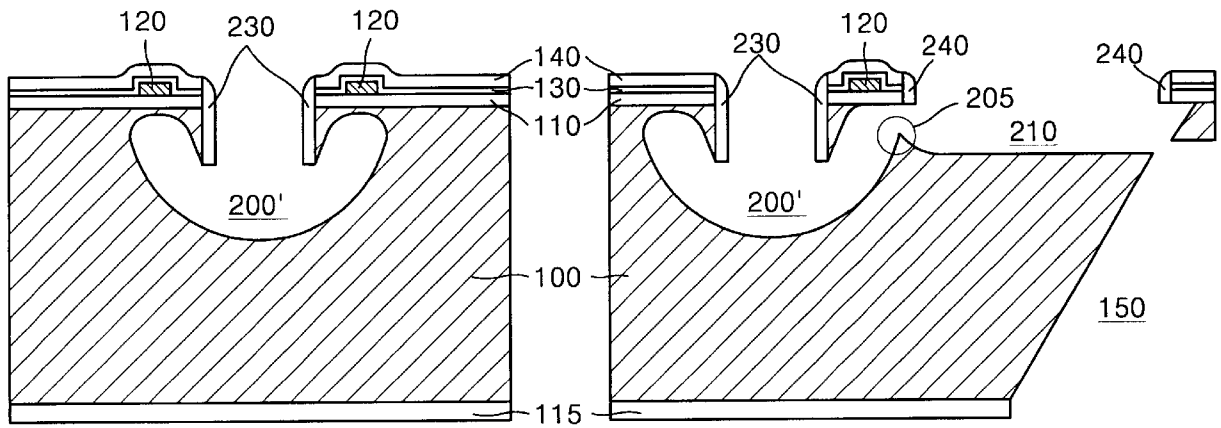

FIGS. 20–22 illustrate cross-sections showing a method of manufacturing the printhead according to the second embodiment of the present invention. The manufacturing method according to this embodiment is the same as the first embodiment up to the step illustrated in FIG. 18, and the method according to this embodiment may further include the steps shown in FIGS. 20 and 21.

Specifically, as shown in FIG. 20, the photoresist layer PR is removed in a state shown in FIG. 18 and then a predetermined material layer such as a TEOS oxide layer 220 is deposited over the resulting material to a thickness of about 1 $\mu$m. Subsequently, the TEOS oxide layer 220 is anisotropically etched so that the silicon substrate 100 is exposed to form spacers 230 and 240 along sidewalls of the trench 190 and the opening 170, respectively, as shown in FIG. 21. The exposed silicon substrate 100 is isotropically etched in a state shown in FIG. 21 like in the first embodiment, thus completing the printhead according to the second embodiment of the present invention.

Although this invention has been described with reference to preferred embodiments thereof, it will be understood by those of ordinary skill in the art that various modifications may be made to the invention without departing from the spirit and scope thereof. For example, materials forming the elements of the printhead according to this invention may not be limited to illustrated ones. That is, the substrate 100 may be formed of a material having good processibility, which is other than silicon, and the same is true of the heater 120, the electrode 180, a silicon oxide layer, or a nitride layer. Furthermore, the stacking and formation method for each material layer are only examples, and thus a variety of deposition and etching techniques may be adopted.

Also, the sequence of processes in method of manufacturing a printhead according to this invention may be varied. For example, etching the rear surface of the substrate 100 for forming the manifold 150 may be performed before the step shown in FIG. 15 or after the step shown in FIG. 17, that is, the step of forming the nozzle 160. Furthermore, the step of forming the electrodes 180 may be performed before the step shown in FIG. 17.

Along therewith, specific numeric values illustrated in each step may be adjusted within a range in which the manufactured printhead can operate normally.

As described above, according to this invention, the bubble is doughnut-shaped thereby preventing a back flow of ink and cross-talk between adjacent ink ejectors. The ink chamber is hemispherical, the ink channel is shallower than the ink chamber, and the bubble barrier projects at the connection portion of the ink chamber and the ink channel, thereby also preventing a back flow of ink.

The shape of the ink chamber, the ink channel, and the heater in the printhead according to this invention provide a high response rate and high driving frequency. Furthermore, the doughnut-shaped bubble coalesces at the center, which prevents the formation of satellite droplets.

The printhead according to the second embodiment of the invention allows the droplets to be ejected exactly in a direction perpendicular to the substrate by forming the bubble guide and the droplet guide on the edges of the nozzle.

Furthermore, according to a conventional printhead manufacturing method, a nozzle plate, an ink chamber, and an ink channel are manufactured separately and bonded to each other. However, a method of manufacturing a printhead according to this invention involves integrating the nozzle plate and the annular heater with the substrate on which the ink chamber and the ink channel are formed, thereby simplifying a fabricating process compared with the conventional manufacturing method. Furthermore, this prevents occurrences of misalignment.

In addition, the manufacturing method according to this invention is compatible with a typical manufacturing process for a semiconductor device, thereby facilitating high volume production.

What is claimed is:

1. A method of manufacturing a bubble-jet type ink-jet printhead, the method comprising the steps of:

forming a nozzle plate on a surface of a substrate;

forming an annular heater on the nozzle plate;

etching the substrate and forming a manifold for supplying ink;

forming electrodes electrically connected to the annular heater on the nozzle plate;

etching the nozzle plate and forming a nozzle having a diameter less than an inner diameter of the annular heater;

etching the substrate exposed by the nozzle and forming a substantially hemispherical ink chamber having a diameter greater than that of the annular heater, wherein forming the ink chamber includes:

anisotropically etching the substrate exposed by the nozzle to a predetermined depth to form a trench;

depositing a predetermined material layer over the anisotropically etched substrate to a predetermined thickness;

anisotropically and partially etching the material layer to expose the bottom of the trench and forming a spacer of the material layer along the sidewalls of the trench; and isotropically etching the substrate exposed to the bottom of the trench; and etching the substrate between the manifold and the ink chamber from the surface and forming an ink channel for connecting the ink chamber with the manifold.

2. The method of claim 1, wherein forming the ink channel comprises the steps of:

etching the nozzle plate from the outside of the annular heater toward the manifold and forming a groove for exposing the substrate; and isotropically etching the substrate exposed by the groove.

3. The method of claim 1, wherein the steps of forming the ink chamber and the ink channel are performed at the same time.

4. The method of claim 1, wherein the heater is horseshoe-shaped.

5. The method of claim 1, wherein the heater is round.

6. The method of claim 1, wherein the substrate is formed of silicon having a crystal orientation of [100].

7. The method of claim 6, wherein, in the step of forming the nozzle plate, the nozzle plate is formed of a silicon oxide layer formed by oxidating the surface of the silicon substrate.

8. The method of claim 1, wherein the heater is formed of polycrystalline silicon.

* * * * *